United States Patent [19]

Kitayama et al.

[11] 4,256,428

[45] Mar. 17, 1981

[54] APPARATUS FOR AUTOMATICALLY FITTING RUNNER BRICKS

[75] Inventors: Shoji Kitayama; Hiroaki Okamitsu; Motohiko Nakatani; Toshiroh Shibata, all of Kitakyushu, Japan

[73] Assignee: Sumitomo Metal Industries Limited, Osaka, Japan

[21] Appl. No.: 8,179

[22] Filed: Jan. 31, 1979

[30] Foreign Application Priority Data

Feb. 1, 1978 [JP] Japan ..... 53-11223

[51] Int. Cl.[3] ..... B65G 59/04; B22D 7/00

[52] U.S. Cl. ..... 414/121; 414/70; 414/752; 294/12; 164/339

[58] Field of Search ..... 414/120, 121, 113, 34, 414/70, 71, 72, 28, 589–591, 252; 294/12; 212/11, 14; 164/137, 339

[56] References Cited

U.S. PATENT DOCUMENTS

| | | | |
|---|---|---|---|
| 2,941,675 | 6/1960 | Noble et al. | 212/14 |
| 2,980,265 | 4/1961 | Johnson et al. | 414/120 X |
| 3,917,081 | 11/1975 | Pearne et al. | 414/34 X |
| 4,108,933 | 8/1978 | Göransson et al. | 414/121 X |

FOREIGN PATENT DOCUMENTS

| | | | |
|---|---|---|---|
| 1433928 | 5/1970 | Fed. Rep. of Germany | 414/121 |
| 105008 | 8/1976 | Japan . | |

*Primary Examiner*—Leslie J. Paperner
*Assistant Examiner*—Terrance L. Siemens
*Attorney, Agent, or Firm*—Watson, Cole, Grindle & Watson

[57] ABSTRACT

An apparatus for automatically fitting runner bricks provided with a brick conveying apparatus comprising a movable gate-shaped girder, a lifting device moved by a traversing device mounted on the girder, a rotating device provided at the lower end of the lifting device and rotatable in a horizontal plane, a sliding device slidable in the horizontal direction at the lower end of the rotating device, and a gripping device provided with a vacuum-sucking device at the lower end of the sliding device, a surface plate rotating apparatus which can rotate a horizontal ingot making surface plate within a range in which the above mentioned traversing device can move, a movable work carriage loaded with bricks and a carriage position detecting apparatus which can be fixed on the work carriage running track and is provided, as required, with a brick aligning device for aligning the bricks on the uppermost step of the bricks mounted on the work carriage. With such apparatus, bricks can be fitted into running slots positively and quickly and the entire apparatus can be automated.

10 Claims, 11 Drawing Figures

APPARATUS FOR AUTOMATICALLY FITTING RUNNER BRICKS

BACKGROUND OF THE INVENTION

1. Field of the Invention

This invention relates to an apparatus for automatically fitting runner bricks wherein bricks to form runners are automatically conveyed and fitted into runner slots provided on an ingot making surface plate in a steel making plant, and more particularly to a brick aligning device for aligning bricks mounted on a work carriage in apparatus for automatically fitting runner bricks.

2. The Prior Art

Generally, in casting a plurality of ingots on a surface plate, runner bricks having runner holes are fitted into a plurality of runner slots extending radially from a pouring port provided in the center of the surface plate from the upper surfaces of the slots so as to form runners communicating with the ingot casting mold. However, the operation of fitting the runner bricks into the runner slots on the above mentioned surface plate is carried out manually in a high heat environment and it is desirable to save labor costs. Therefore, there has been suggested the apparatus described in Japanese Utility Model Laid Open Publication No. 105008/51 published on Feb. 19, 1975, wherein a rotating arm having a gripping device is installed near a surface plate so that bricks may be held by the gripping device, rotated and moved onto the surface plate and may be fitted into slots by lowering the gripping device. However, such apparatus has defects such as, when the diameter of the surface plate reaches several meters, the positioning precision of rotating the surface plate until it stops so as to coincide with the rotating arm is limited. Also, when the brick is held with the gripping device, the relative positions of the brick and gripping device are erroneous, as the gap between the brick and runner slot is so small as to be about 2 mm, the positions of the brick and runner slot do not coincide with each other and require a considerable time to be corrected such that there is a lengthy working time. The gap between the runner slot and brick is so small that, when the brick is held in the width direction, at the time of fitting it, the gripping pawl is in the way and the brick is dropped into the slot. Therefore the brick is held in the lengthwise direction and when a plurality of bricks are simultaneously held and conveyed, the holding force is determined by the friction force between the bricks with each other. Thus, if the surface state and material of the brick are slippery, the holding force is unstable and bricks are likely to drop while being conveyed.

SUMMARY OF THE INVENTION

An object of the present invention is to provide an apparatus for automatically fitting runner bricks wherein such defects are eliminated, the position of a brick to be held is determined in advance so that the relative error with a gripping device may be eliminated, while the precision of fitting the brick in a slot is retained. The gripping device is able to move in the vertical direction and to slide and rotate so as to make a fine adjustment with the slot position, and is provided with a vacuum-sucking device to positively hold the brick being conveyed.

Another object of the present invention is to provide a brick aligning device in the above mentioned apparatus to avoid such danger that, as the bricks mounted on the work carriage are usually concavoconvexly fitted with each other but are loosely fitted in the joint parts, the row of the bricks is bent by vibrations or the like during conveyance and, if the bricks are held as they are with the gripping device, the holding force is so unstable that the bricks drop in the course of conveyance.

DETAILED DESCRIPTION OF THE PREFERRED EMBODIMENTS

Figures 1, 2, 4:
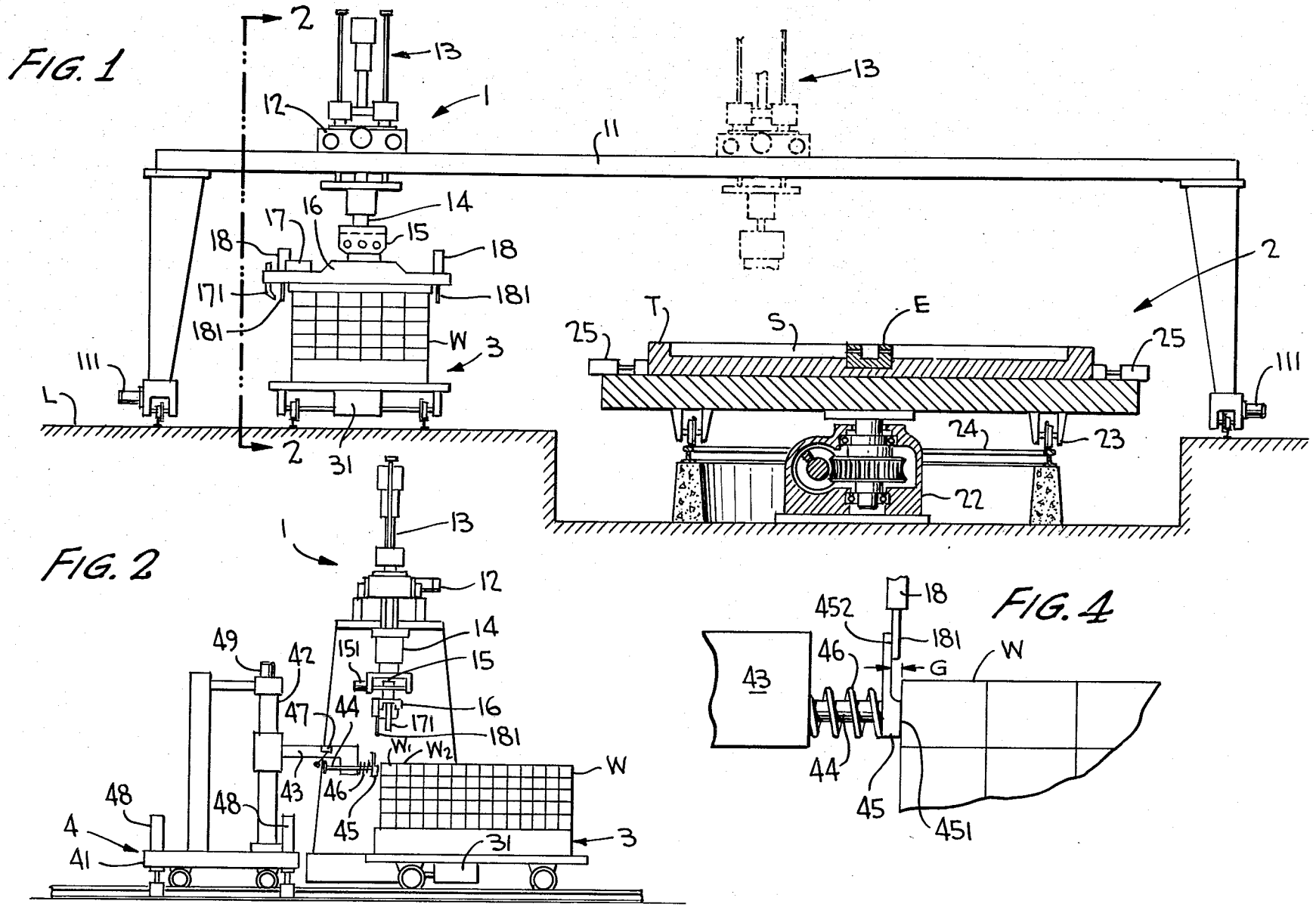
FIG. 1 is a partly sectioned elevation of an apparatus for automatically fitting runner bricks according to the present invention.
FIG. 2 is a sectioned view on line II—II in FIG. 1.
FIG. 4 is an explanatory view showing the relation between an embodiment of a carriage position detecting apparatus and a work carriage.

Brick conveying apparatus 1 for holding and conveying runner bricks W has a gate-shaped girder 11 movable on a floor base L by driving devices 111, is moved by traversing device 12 along the girder and is lifted and lowered by lifting device 13. Sliding device 15 sliding in the horizontal direction is provided at the lower end of rotating device 14 fitted to the lower end of lifting device 13 so as to be rotatable in the horizontal plane and is provided with gripping device 16.

Figure 3:
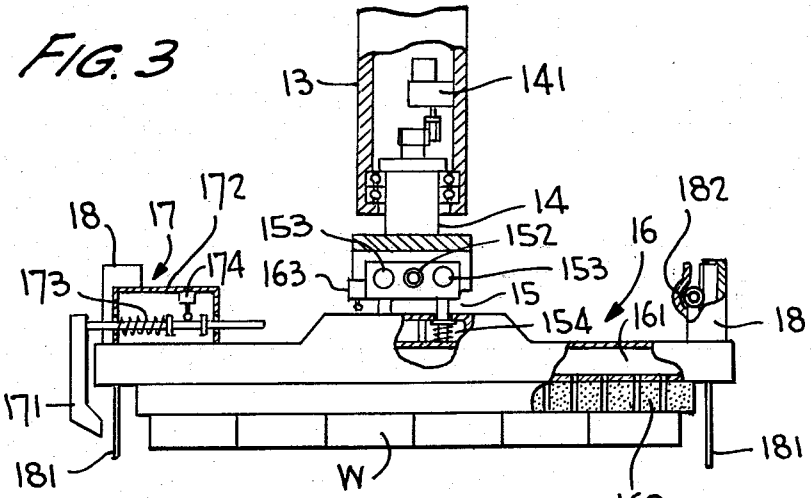
FIG. 3 is a magnified partial elevation of a brick conveying apparatus.

Rotating device 14 is rotated and driven by motor 141 (FIG. 3) and is fitted in the lower end part with feeding screw 152 and guide rod 153 of sliding device 15 in the horizontal direction so that feeding screw 152 is rotated and driven by feeding motor 151. Sliding device 15 is driven by feeding screw 152 and engaged with the guide rods 153 to slide therealong.

Gripping device 16 is provided on sliding device 15 so as to be vertically slidable through cushioning springs 154, has a length corresponding to a plurality of required bricks and is provided with vacuum-sucking device 161 connected with a vacuum device (not illustrated) so as to suck the bricks W. Sucking pad 162, which is made of an elastic body having ventilating holes and with which bricks W are to be sucked into close contact, is provided on the contact surface with the bricks W. Limit switch 163 operates when cushioning springs 154 are displaced by a predetermined amount. Pawl device 17, provided at one end of gripping device 16, has pawl 171. Pawl supporter 172 bears pawl 171 and is elastically fitted in the lengthwise direction of gripping device 16 through spring 173. Limit switch 174, secured to pawl supporter 172, stops traversing device 12 when spring 173 is displaced by a predetermined amount. Slot detector 18, secured to each end part of gripping device 16, is provided with feeling needle 181 which issues a signal when it contacts an object and can be pulled up, as required, by lifting motor 182.

Surface plate rotating apparatus 2, on which ingot making surface plate T provided with radial runner slots S is mounted, is rotated horizontally with its center as an axis and is provided with turntable 21 fixing the surface plate T and rotated by rotating driving device 22. Wheels 23 supporting turntable 21 are made to be rollable on annularly set guide rail 24. Clamping device 25 retains surface plate T.

Work carriage 3 for mounting and conveying a plurality of bricks W is made to be run and driven by driving device 31 mounted therein.

Carriage position detecting apparatus 4, fixed opposite to the work carriage on the running track of work carriage 3, includes machine base 41, sliding pillar 42 and lifting arm 43 which lifts and lowers along the sliding pillar and projects horizontally in the moving direction of work carriage 3. Detecting rod 44, slidable in the projecting direction of lifting arm 43, has contact plate 45 provided at one end, contacting bricks W on work carriage 3, and is of a length to simultaneously contact the feeling needles on both sides of the brick conveying apparatus 1 and is provided with contact surface 451 contacting the side surface of brick W and projecting surface 452 displaced from contact surface 451 by gap G when brick W is fitted into runner slot S. Compression spring 46 is provided between contact plate 45 and lifting arm 43. Position detector 47, provided in lifting arm 43, converts the displacement of detecting rod 44 into an electric signal.

Rail clamp 48 is provided on machine base 41. Lift operating device 49 is part of lifting arm 43.

Figure 9:
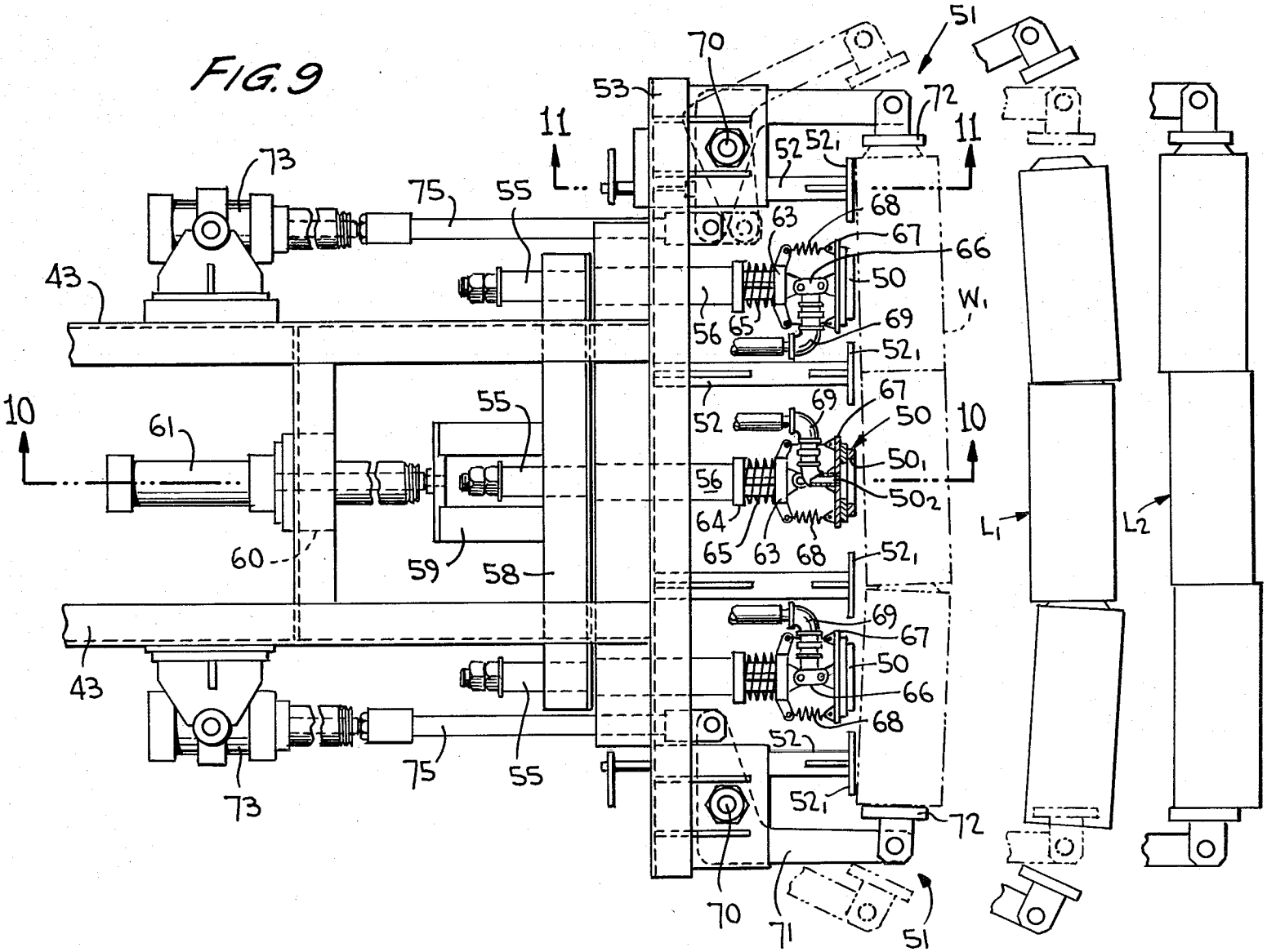
FIG. 9 is a magnified plan view of another embodiment of the carriage position detecting apparatus provided with a brick aligning device.
Figure 10:
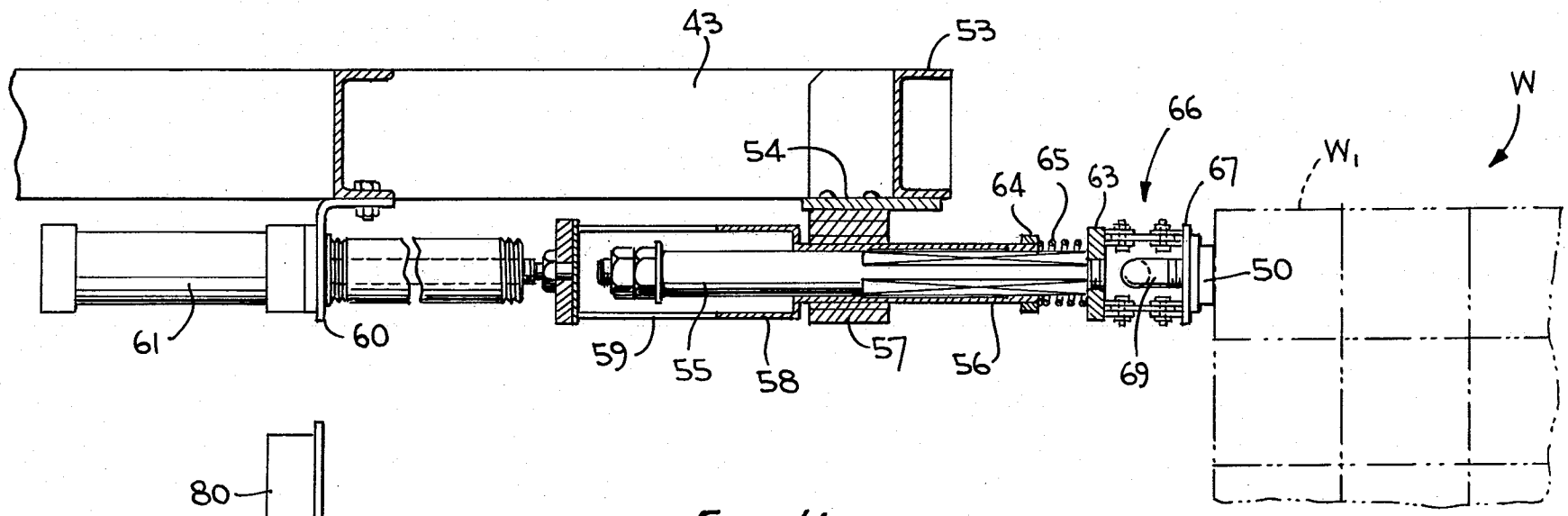
FIG. 10 is a sectioned view on line X—X in FIG. 9.
Figure 11:
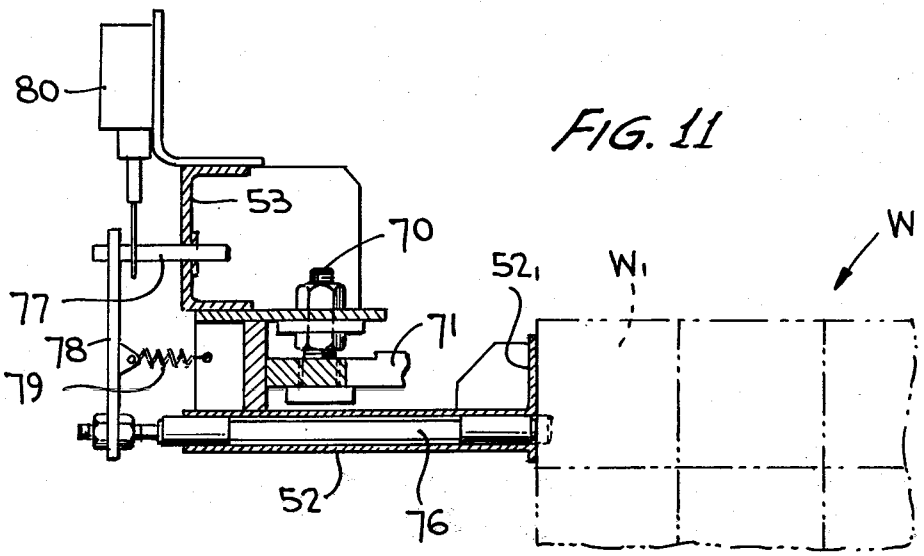
FIG. 11 is a sectioned view on line XI—XI in FIG. 9.

Another embodiment of a carriage position detecting apparatus provided with a brick aligning device is illustrated in FIGS. 9 to 11. The same reference numerals are used for the same respective members as in the above described embodiment.

In carriage position detecting apparatus 4 according to this embodiment, a plurality of sucking pads 50 for aligning bricks are provided in the tip part of lifting arm 43 so as to slide horizontally in the projecting direction of lifting arm 43. Brick clamping devices 51 and brick aligning stoppers 52 are respectively integrally provided in lifting arm 43. Thus, in this embodiment, fixed plate 54 is provided to project below the back surface of supporting rod 53 laterally provided at the tip of lifting arm 43. A number (three in this embodiment) corresponding to the number of bricks of supporting shafts 55 are respectively fixed in bearings 57 through sleeves 56 so as to slide horizontally in the projecting direction of lifting arm 43 at regular intervals on fixed plate 54 and are connected so as to integrally operate with frame body 58 provided integrally with respective sleeves 56. Projecting frame 59 is provided to project in the middle of frame body 58 and cylinder 61 is fitted to lifting arm 43 through angle member 60 and are connected with each other so that the above mentioned three supporting shafts 55 may be simultaneously operated by cylinder 61. Sucking pad 50 for aligning bricks is fitted angularly variably to the tip of each of the above mentioned supporting shafts by providing spring 65 between spring seat 63 secured to the tip of supporting shaft 55 and spring seat 64 secured to sleeve 56 so as to be normally of a free length, to act as a compression spring at the time of starting the suction and to act as a tension spring during no suction periods. Also, sucking pad 50 is angularly variably fitted through link mechanism 66 to spring seat 63 secured to supporting shaft 55 and return spring 68 is hung between spring seats 63 and 67 to hold sucking pad 50.

Sucking pad 50 is made of an elastic body having ventilating hole $50_1$ with which the brick is to be sucked in close contact so that a negative pressure may be made within the sucking pad through air piping 69 connected to hole $50_2$ made in the center of spring seat 67. Spring 65 of supporting shaft 55 has a tensile force smaller than the brick sucking force, and has a force larger than the weight of all elements including supporting shaft 55 and sucking pad 50 fitted to the supporting shaft when the sucking is released. Spring 65 has a compressive force smaller than the brick friction force and has a force sufficient to move sucking pad 50 through link mechanism 66 into close contact with the brick and is used so that the sucking pad may be automatically retracted to its original position simultaneously with the release of the suction.

Clamping device 51 for clamping the bricks to be aligned is provided at the tip of lifting arm 43. In this device, clamping pawl 71 is rotatable with shaft 70 as a fulcrum and is provided in each end part of the above mentioned supporting rod 53 provided at the tip of the lifting arm, and is fitted at the tip with holding plate 72 and is connected in the lower part with rod 75 connected to a simultaneously operating cylinder 73 secured to lifting arm 43 so that both clamping pawls 71 may be opened and closed with cylinders 73.

Further, on supporting rod 53, a plurality of brick aligning stoppers 52 are provided to project on the same level as the base line of feeling needle 181 of slot detector 18 adjacent to each sucking pad 50. Brick contacting plates $52_1$ of stoppers 52 are respectively on the same line so that, when the bricks are sucked to sucking pads 50 and contacted with stoppers 52, they are aligned. In each end of each stopper 52 as shown in FIG. 11, brick contacting rod 76 for stopping work carriage 3 and operating the above mentioned clamping device is slidably contained, is fitted to fixed plate 78 provided integrally with supporting shaft 77 passed slidably through supporting rod 53 and is held with spring 79 to normally partly project from the tip of stopper 52 and to operate work carriage stopping switch 80 mounted to supporting rod 53 through fixed plate 78.

The operation of the present invention is as follows.

Now, in order to fit bricks W into slots S on surface plate T (carried by a crane not illustrated onto the turntable 21), first of all, brick conveying apparatus 1 is moved to a substantially central position of surface plate T by driving devices 111, and then carriage position detecting apparatus 4 is moved and fixed so that contact plate 45 is within the operating range of gripping device 16. By properly lifting lifting arm 43 of carriage position detecting apparatus 4, contact plate 45 is stopped at a level contacting the side surface of brick W on the uppermost step of work carriage 3. Work carriage 3 is made to approach carriage position detecting apparatus 4. When contact surface 451 of contact plate 45 contacts bricks $W_1$ on the uppermost step of work carriage 3, and a signal is issued by position detector 47, work carriage 3 is stopped. Then, brick conveying apparatus 1 is moved on girder 11 by traversing device 12 and is stopped at a position in which gripping device 16 is above the row of bricks $W_1$ contacting contact plate 45. Gripping device 16 is lowered by lifting device 13 to a position in which feeling needles 181 of slot detectors 18 provided in both end parts of holding device 16 contact projecting surface 452 of contact plate 45. Then, by operating sliding device 15, holding device 16 is moved until the side surface of feeling needle 181 contacts projecting surface 452 of contact plate 45. In this contacting position, gripping device 16 is further lowered to bring sucking pad 162 into contact with bricks $W_1$. A negative pressure is made within vacuum-sucking device 161 by a vacuum device not illustrated. Bricks $W_1$ are sucked to sucking pad 162. The required bricks $W_1$ arranged in a row are thus gripped simultaneously and are carried onto surface plate T as shown by the dotted lines in FIG. 1 by lifting device 13 and traversing device 12.

Figure 6:
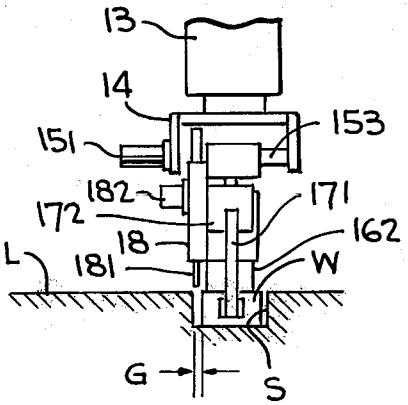
FIGS. 5 and 6 are explanatory views showing bricks being fitted in runner slots.
Figure 5:
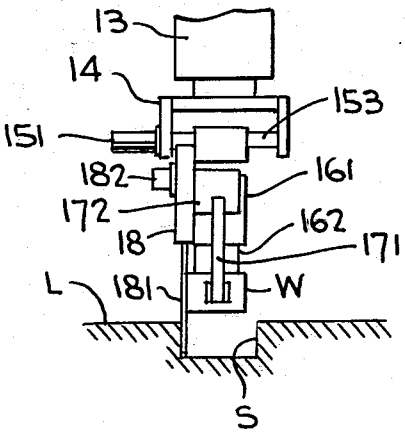

On surface plate T, predetermined runner slot S is positioned to be substantially parallel with girder 11 by surface plate rotating apparatus 2 in advance. Gripping device 16 grips bricks $W_1$ and is lowered by lifting device 13 to the level at which feeling needle 181 of slot detector 18 enters the predetermined runner slot S as shown in FIG. 5. Gripping device 16 is moved and adjusted by sliding device 15 so that feeling needle 181 contacts the inner wall of runner slot S. At this time, as only one of feeling needles 181 of slot detectors 18 at both ends is in contacting relationship, no signal is issued from the other slot detector 18, but detection that the direction of gripping device 16 deviates diagonally with runner slot S, and therefore an instruction is given to rotating device 14 to correct the rotation so that both feeling needles make contact. While the side surfaces of both feeling needles 181 are in contact with the inner wall of runner slot S, when gripping device 16 is further lowered by lifting device 13, as shown in FIG. 6, bricks W are fitted accurately into runner slot S by keeping a predetermined gap G from the inner wall of runner slot S, cushioning springs 154 deflect, limit switch 163 operates to detect the position at which bricks W contact the bottom of slot S and a positive pressure is made in vacuum-sucking device 161 to release bricks W. Gripping device 16 is separated from the fitted bricks, feeling needles 181 of slot detectors 18 are pulled up, then brick conveying apparatus 1 is further moved toward the center of surface plate T by traversing device 12 and the fitted bricks W are pushed by pawl 171 provided on gripping device 16 to be pressed and connected with pouring port brick E fitted in advance into the center of the surface plate to finish the fitting.

Surface plate T is rotated by surface plate rotating apparatus 2 to set the next runner slot parallel with girder 11 and bricks $W_2$ are conveyed and fitted in the same manner as previously described.

Figure 7:
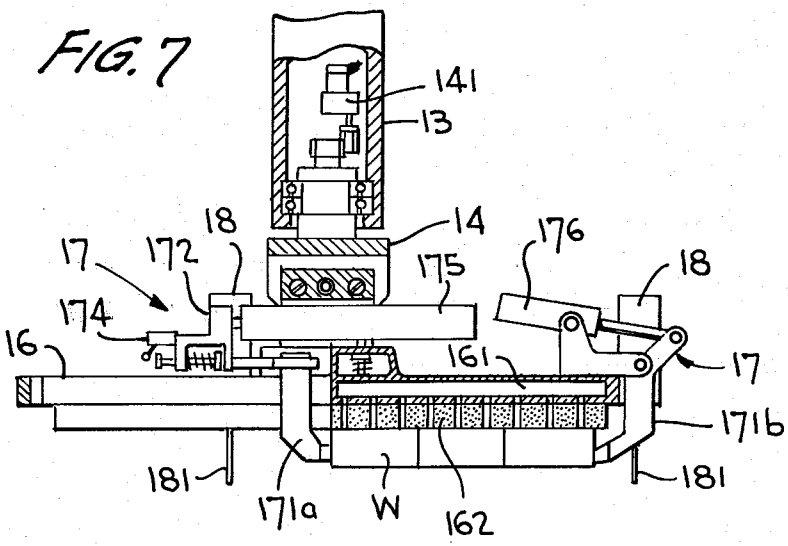
FIG. 7 is a magnified partial elevation showing another embodiment of a brick conveying apparatus.
Figure 8:
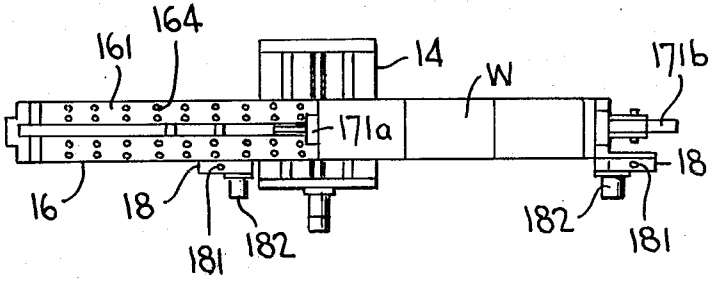
FIG. 8 is a bottom view of FIG. 7.

If runner slot S is short and the runner bricks W are few, as shown in FIGS. 7 and 8, pawl 171*a* is made movable by pawl supporter 172 by actuator 175 in slot 164 provided in the lengthwise direction of gripping device 16 and at least one of slot detectors 18 is secured to pawl supporter 172 to be moved in the lengthwise direction of gripping device 16 in conformity with the length of runner slot S. Also, if pawl devices 17 are provided at both ends, and at least one of them is provided with actuator 176 so as to open and close pawl 171*b* so as to hold the bricks from both ends during their conveyance, the bricks are conveyed more positively.

Also, pawl devices to hold bricks W mounted on work carriage 3 may be provided at both ends of contact plate 45 of carriage detecting apparatus 4 to eliminate any gap between the bricks W in the row so that, when the bricks are sucked by vacuum-sucking device 161 in advance, the ventilating holes in vacuum-sucking device 161 are not exposed.

The operation of the automatically fitting apparatus provided with the brick aligning device is substantially the same as described above. That is, first of all, carriage position detecting apparatus 4 is moved and fixed in the predetermined position in the same manner as described above. By properly lifting and lowering lifting arm 43 of the carriage position detecting apparatus, sucking pad 50 is stopped on the level at which it contacts the side surfaces of bricks $W_1$ on the uppermost step of work carriage 3. Work carriage 3 is made to approach the carriage position detecting apparatus. When the tip of brick contacting rod 76 contained in stopper 52 contacts bricks $W_1$ on the uppermost step mounted on the work carriage and switch 80 operates, work carriage 3 stops and, at the same time, cylinder 73 operates to clamp bricks $W_1$ with clamping device 51. In case bricks $W_1$ on the uppermost step mounted on the work carriage at this time are deranged in the row, for example, as shown at $L_1$ in FIG. 9, in order to align them, when bricks $W_1$ on the uppermost step are clamped and are corrected in the positions in the row $L_2$, cylinder 61 is then operated to advance sucking pads 50 and compress springs 65, and the respective sucking pads closely contact the corresponding bricks while providing cushioning, a negative pressure is made within sucking pads 50 by a vacuum device to such bricks $W_1$ to sucking pads 50.

Then, the bricks are released from the clamps, cylinder 61 is now operated in the reverse direction to retract sucking pads 50 and bricks $W_1$ are pulled to stoppers 52. As a result, bricks $W_1$ are aligned in a row on the stopper line. When bricks $W_1$ on the uppermost step are thus aligned, a positive pressure is made within sucking pads 50. When sucking pads 50 are kept under the positive pressure, by the action of return spring 65 of each supporting shaft, sucking pads 50 automatically separate from bricks $W_1$ and the sucking pads return to their original positions.

When the above operation ends, in the same manner as is described above, brick gripping device 16 is lowered and the aligned bricks $W_1$ on the uppermost step are gripped simultaneously, and conveyed onto surface plate T by lifting device 13 and traversing device 12, and the bricks are fitted into runner slots S on the surface plate.

As described above, the present invention is provided with a brick conveying apparatus comprising a movable gate-shaped girder, a lifting device moved by a traversing device on the above mentioned girder and able to lift and lower by sliding on the traversing device; a rotating device rotatable in the horizontal direction below the lifting device; a sliding device movable in the horizontal direction below the rotating device and a gripping device having a vacuum-sucking device and sucking pad below the sliding device; a surface plate rotating apparatus which can rotate a surface plate as held horizontally below the above mentioned girder; a movable work carriage and a carriage position detecting apparatus which can be fixed on the running track of the work carriage. Therefore, the positions of the surface plate and work carriage feeding bricks can be accurately adjusted. The conveying work by the brick conveying apparatus is positive and smooth. A plurality of bricks to be fitted into a runner slot can be conveyed at once, any deranged bricks in the row on the uppermost step mounted on the work carriage can be aligned simultaneously. The sucking device acts on the respective bricks to hold them positively so as not to drop them during their conveyance. The conveying apparatus is so made to rotate and slide separately from the girder movement and lift along the girder. Therefore, the gripping device can be accurately stopped along the runner slot. The time for the fitting positioning can be made very short and the working time can be remarkably improved.

Further, there are such effects that the gripping device can be fitted with slot detectors and pawl devices, the operations of detecting the fitting position and eliminating the gap between the fitted bricks can be automated, and the apparatus can be completely automated.

What is claimed is:

1. An apparatus for automatically fitting runner bricks in slots in an ingot-making plate and having a brick conveying apparatus, comprising:

a movable gate-shaped girder;

a lifting device moved by a traversing device mounted on said girder;

a rotating device provided at the lower end of said lifting device and rotatable in a horizontal plane;

a sliding device slidable in a horizontal direction at the lower end of said rotating device;

a gripping device including a vacuum-sucking device at the lower end of said sliding device;

a rotating apparatus for rotating a horizontal ingot-making surface plate within a range in which said traversing device can move;

a movable work carriage including a running track and loaded with bricks; and a carriage position detecting apparatus adapted to be fixed on the work carriage running track.

2. The apparatus according to claim 1 wherein said carriage position detecting apparatus includes a brick aligning device.

3. The apparatus according to claim 2 wherein said brick aligning device comprises a lifting arm projecting in the moving direction of said work carriage on a machine base fixed as opposed to said carriage on the running track of the work carriage, sucking pads for aligning bricks arranged at regular intervals on the same level at the tip of said lifting arm so as to slide simultaneously in the horizontal direction in the projecting direction of said lifting arm, a clamping device, and stoppers for aligning bricks provided on said lifting arm.

4. The apparatus according to claim 3 wherein each said sucking pad is mounted to have a variable sucking angle by a link mechanism and spring and a return spring for automatically returning the sucking pad simultaneously at the termination of the sucking operation.

5. The apparatus according to claim 1 wherein said gripping device includes a slot detector in each end part in the lengthwise direction, and each said slot detector includes a feeling needle detecting the deviation between the positions of the runner slot and gripping device.

6. The apparatus according to claim 5 wherein at least one of said slot detectors is made movable in the lengthwise direction of said gripping device.

7. The apparatus according to claim 5 wherein said carriage position detecting apparatus includes a lifting arm projecting in the moving direction of said work carriage, a detecting rod horizontally slidable in the projecting direction of the lifting arm, a contact plate having a contact surface contacting the side surfaces of the bricks on said work carriage through the detecting rod, and each said slot detector including a feeling needle, a projecting surface contacting said feeling needle for fitting the bricks into the runner slot from said contact surface.

8. The apparatus according to claim 1 further comprising a pawl device pressing the bricks fitted in the runner slot toward the center of the surface plate and positioned at least at one end of said gripping device.

9. The apparatus according to claim 8 wherein said pawl device is provided at each end of said gripping device and the pawl device at least at one end opens and closes to hold the conveyed bricks at both ends.

10. In an apparatus for automatically fitting runner bricks comprising a running type gate-shaped girder, a self-running work carriage traversing on said girder and including a running track, a lifting device mounted on said carriage, and a brick gripping device fitted to said lifting device so that a plurality of bricks mounted on the self-running work carriage may be gripped, conveyed and fitted into runner slots provided on a rotatable surface plate, a brick aligning device wherein a lifting arm projecting in the moving direction of the work carriage is provided on a machine base fixed opposite to said carriage on the running track of said work carriage, a plurality of sucking pads for aligning bricks arranged at regular intervals on the same level to simultaneously slide horizontally in the projecting direction of said lifting arm at the tip part thereof and having a link mechanism and springs for providing a variable sucking angle and said sucking pads automatically returning simultaneously by return springs with the release of the sucking force, a clamping device and stoppers for aligning bricks mounted on said lifting arm, and a switch for operating the clamping device for stopping the work carriage and aligning the bricks operated through a brick contacting rod contained in said stoppers.

* * * * *